US010632705B2

(12) United States Patent
Kitamura

(10) Patent No.: US 10,632,705 B2
(45) Date of Patent: Apr. 28, 2020

(54) PRESS APPARATUS

(71) Applicant: FANUC CORPORATION, Yamanashi (JP)

(72) Inventor: Ryouji Kitamura, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 16/159,943

(22) Filed: Oct. 15, 2018

(65) Prior Publication Data

US 2019/0134933 A1 May 9, 2019

(30) Foreign Application Priority Data

Nov. 7, 2017 (JP) ..... 2017-214658

(51) Int. Cl.
*B30B 15/00* (2006.01)
*B30B 15/04* (2006.01)
(Continued)

(52) U.S. Cl.
CPC ..... *B30B 15/32* (2013.01); *B30B 15/0094* (2013.01); *B30B 15/047* (2013.01); *B30B 15/148* (2013.01)

(58) Field of Classification Search
CPC ..... B30B 15/02; B30B 15/047; B30B 15/148; B30B 15/28; B30B 15/32; B30B 15/0082;
(Continued)

(56) References Cited

U.S. PATENT DOCUMENTS 4,630,536 A * 12/1986 Shah ..... B30B 15/028 100/229 R
2012/0049397 A1 3/2012 Imai et al.
(Continued)

FOREIGN PATENT DOCUMENTS

CN 102430644 A 5/2012
CN 202606740 U 12/2012
CN 103097078 A 5/2013
CN 206373266 U 8/2017
(Continued)

OTHER PUBLICATIONS

Japanese Office Action (Decision to Grant a Patent) dated Jun. 25, 2019, in connection with corresponding JP Application No. 2017-214658 (5 pgs., including English translation).
(Continued)

*Primary Examiner* — Jimmy T Nguyen
(74) *Attorney, Agent, or Firm* — Maier & Maier, PLLC

(57) ABSTRACT

A press apparatus including: a frame including a support surface, the support surface allowing a lower die support for supporting a lower die to rest on the support surface in close contact therewith; a press shaft configured to support an upper die facing the lower die from vertically above the lower die and to vertically move the upper die relative to the frame in a state where the lower die support rests on the support surface; a chip discharge mechanism configured to rotate the lower die support around a horizontal axis; a force detection unit configured to detect a pressing force of the lower die support against the support surface; and a control unit configured to control the chip discharge mechanism so that the pressing force detected by the force detection unit is equal to or larger than a predetermined threshold.

4 Claims, 13 Drawing Sheets

(51) Int. Cl.
*B30B 15/14* (2006.01)
*B30B 15/32* (2006.01)

(58) Field of Classification Search
CPC .... B30B 15/0094; B21D 45/00; B21D 45/02; B21D 45/04; B29B 17/00; B29C 43/04; B29C 2043/3283
See application file for complete search history.

(56) References Cited

U.S. PATENT DOCUMENTS

| | | | | |
|---|---|---|---|---|
| 2013/0174699 | A1 | 7/2013 | Matsukura et al. | |
| 2014/0047885 | A1* | 2/2014 | Battenfeld ..... | H01R 43/0486 72/21.4 |
| 2017/0313015 | A1 | 11/2017 | Kitamura | |

FOREIGN PATENT DOCUMENTS

| | | | |
|---|---|---|---|
| CN | 206415530 | U | 8/2017 |
| EP | 2 617 520 | A1 | 7/2013 |
| JP | S62-41425 | U | 3/1987 |
| JP | H08-187530 | A | 7/1996 |
| JP | H09-010999 | A | 1/1997 |
| JP | 2000-141159 | A | 5/2000 |
| JP | 2004-291012 | A | 10/2004 |
| JP | 2015-174122 | A | 10/2015 |
| JP | 2017-196650 | A | 11/2017 |

OTHER PUBLICATIONS

Chinese Office Action dated Oct. 15, 2019, in connection with corresponding CN Application No. 201811302390.2 (9 pgs., including machine-generated English translation).

* cited by examiner

PRESS APPARATUS

CROSS-REFERENCE TO RELATED APPLICATIONS

This application claims the benefit of Japanese Patent Application No. 2017-214658, the content of which is incorporated herein by reference.

FIELD

The present invention relates to a press apparatus.

BACKGROUND

Conventionally, a press apparatus including a chip discharge device has been known. The chip discharge device transports chips, which are produced from press work, to a predetermined chip discharge position by a belt conveyor (for example, see Japanese Unexamined Patent Application, Publication No. Hei 8-187530).

SUMMARY

According to an aspect of the present invention, a press apparatus is provided that includes: a frame including a support surface, the support surface allowing a lower die support for supporting a lower die to rest on the support surface in close contact therewith; a press shaft configured to support an upper die facing the lower die from vertically above the lower die and to vertically move the upper die relative to the frame in a state where the lower die support rests on the support surface; a chip discharge mechanism configured to rotate the lower die support around a horizontal axis; a force detection unit configured to detect a pressing force of the lower die support against the support surface; and a control unit configured to control the chip discharge mechanism so that the pressing force detected by the force detection unit is equal to or larger than a predetermined threshold.

DETAILED DESCRIPTION

Hereinafter, a press apparatus 1 according to an embodiment of the present invention will be explained with reference to the drawings.

Figure 1:
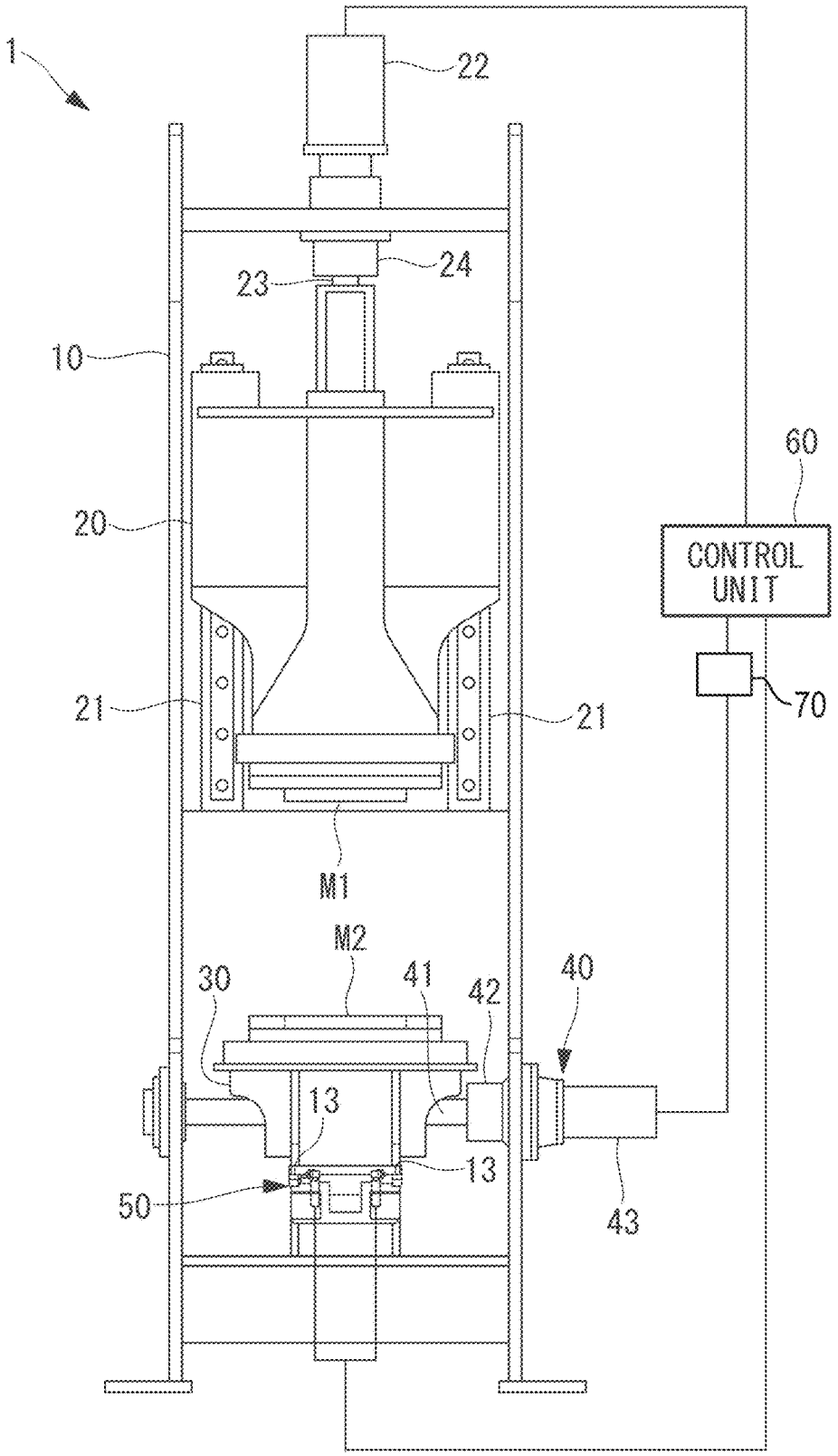
FIG. 1 is a front view of a press apparatus according to an embodiment of the present invention.
Figure 2:
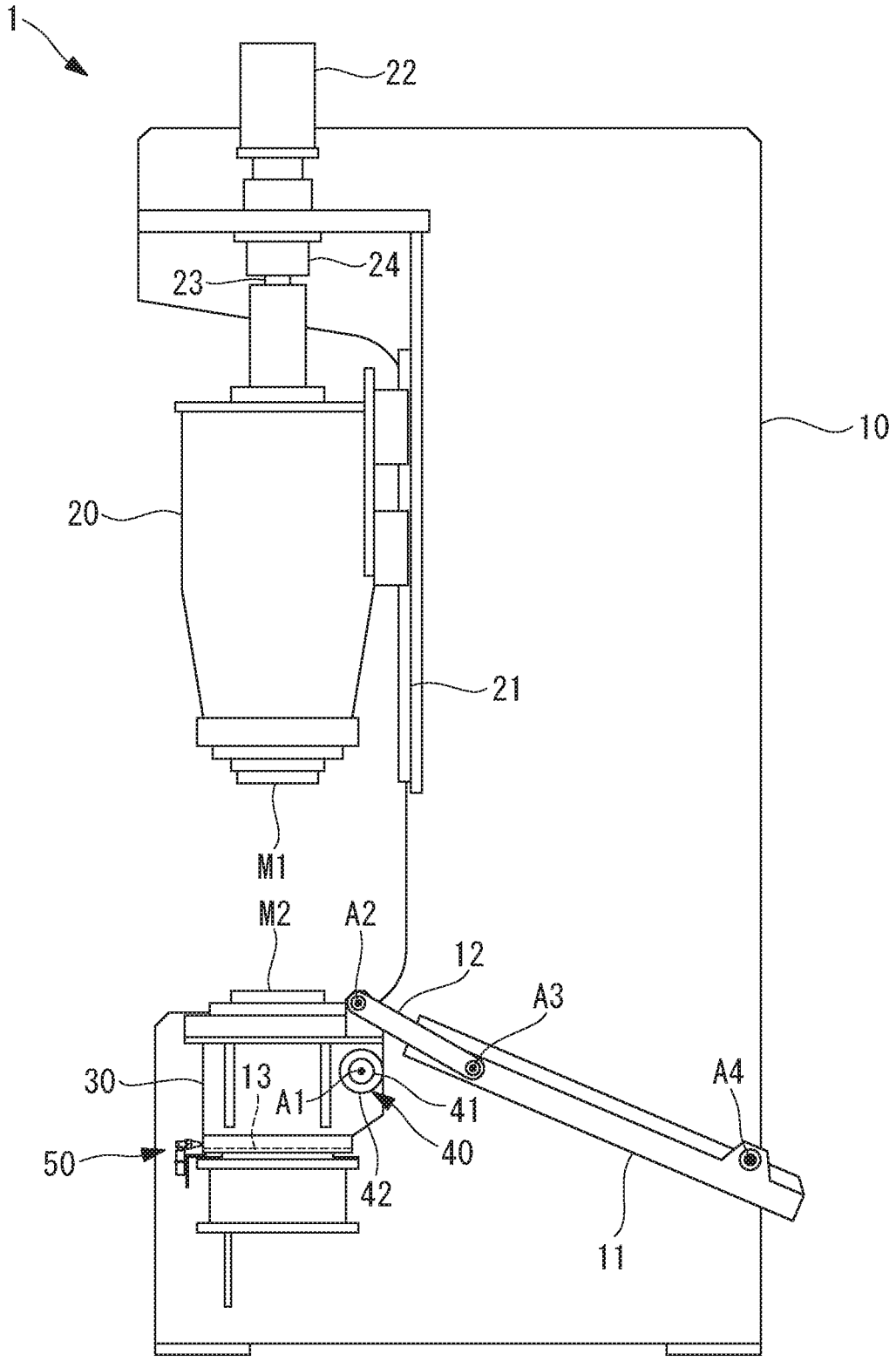
FIG. 2 is a side view of the press apparatus of FIG. 1.

As shown in FIGS. 1 and 2, the press apparatus 1 includes a frame 10, a press shaft 20, a lower die support 30, a chip discharge mechanism 40, a fluid emission unit 50, and a control unit 60. The frame 10 is installed on a base. The press shaft 20 is provided to the frame 10 in a vertically movable manner and mounted with an upper die M1 for press work at a lower end of the press shaft 20. The lower die support 30 is fitted to the frame 10 and mounted with a lower die M2 that is disposed so as to face the upper die M1 mounted to the lower end of the press shaft 20. The chip discharge mechanism 40 rotates the lower die support 30 around a horizontal axis. The control unit 60 controls the press shaft 20, the chip discharge mechanism 40 and the fluid emission unit 50.

Referring to FIG. 2, the press apparatus 1 further includes a chip shooter 11 supported by the frame 10, and a pair of link members 12 one ends of which are connected to the lower die support 30 and other ends of which are connected to the chip shooter 11.

The press shaft 20 is supported by a linear guide 21 fixed to the frame 10 such that the press shaft 20 moves linearly and vertically relative to the frame 10. In the example shown in FIG. 1, the press shaft 20 is linearly and vertically moved by a known mechanism that uses a servomotor 22 and a ball screw 23 to linearly and vertically move the press shaft 20.

In the present embodiment, for example, the press shaft 20 includes a nut (not shown in the figure) having a female screw hole (not shown in the figure) vertically running in the press shaft 20, and the ball screw 23 rotatably supported by the frame 10 is screwed into the female screw hole of the nut. Further, a reducer 24 is disposed at an upper end of the ball screw 23, and a rotational force of the servomotor 22 is transmitted to the ball screw 23 via the reducer 24. The press shaft 20 is restricted from rotating relative to the frame 10, and the ball screw 23 is restricted from moving vertically relative to the frame 10. Accordingly, rotation of the servomotor 22 causes the press shaft 20 to move linearly and vertically.

The chip discharge mechanism 40 includes a support shaft 41 extending in a horizontal direction and fixed to a part of the lower die support 30. The support shaft 41 is rotatably mounted to the frame 10, and one end of the support shaft 41 is fitted with a servomotor 43 via a reducer 42. Activation of the servomotor 43 causes the lower die support 30 to rotate around the horizontal axis A1 between a position where the lower die support 30 is supported by a support surface 13 of the frame 10 from below and a position where the lower die support 30 is tilted away from the support surface 13.

Figure 3:
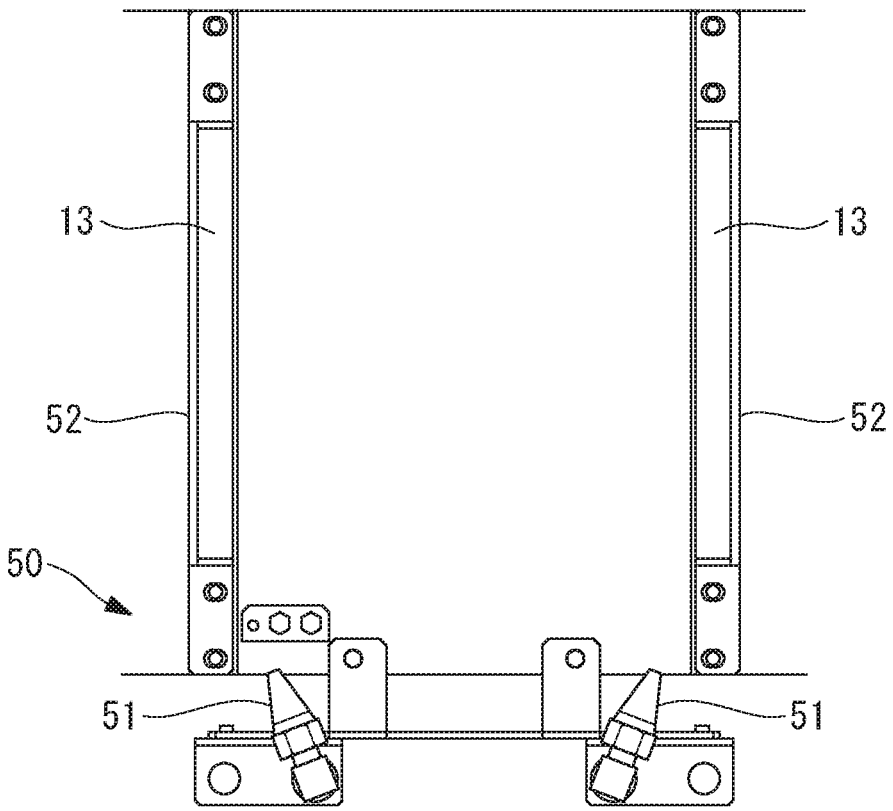
FIG. 3 is a plan view of a support surface and a fluid emission unit of the press apparatus of FIG. 1.
Figure 4:
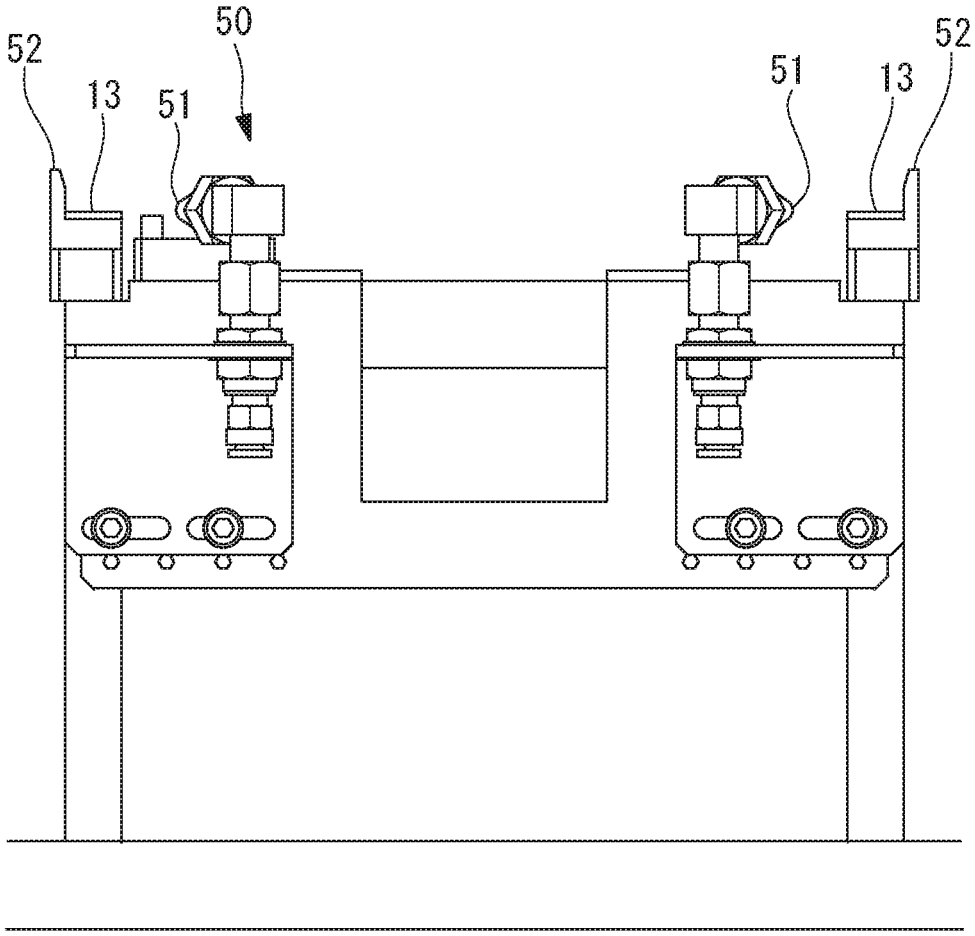
FIG. 4 is a front view of the support surface and the fluid emission unit of FIG. 3.

As shown in FIGS. 3 and 4, the support surfaces 13 are two horizontal planes extending in the horizontal direction like a belt. The support surface 13 closely contacts a bottom face of the lower die support 30 and thereby supports the lower die support 30 with the planes.

Figure 5:
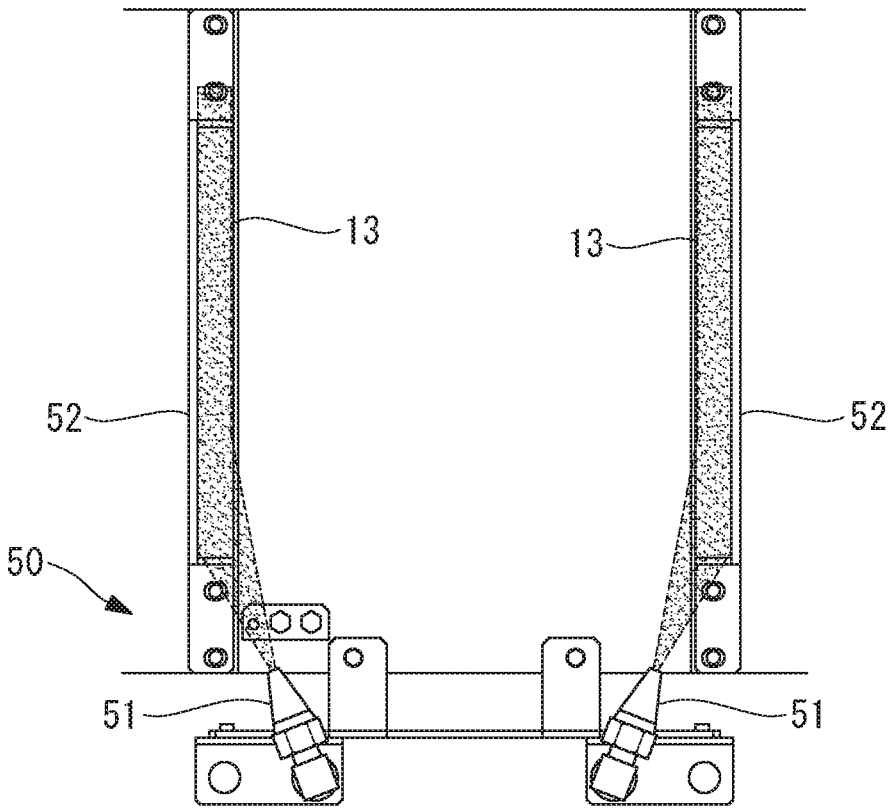
FIG. 5 is a plan view explaining an operation of the fluid emission unit of FIG. 3.

As shown in FIGS. 3 to 5, the fluid emission unit 50 includes emission nozzles 51 and straightening plates 52. The emission nozzles 51 emit a fluid, for example air, laterally toward the support surface 13 and in a horizon direction along the support surface 13. The straightening plates 52 are on the respective sides of the support surface 13 and shaped in a side wall rising from the support surface 13.

As shown in FIG. 5, each straightening plate 52 is on the opposite side of the support surface 13 from the emission nozzle 51 in the horizontal direction and inclined at less than 90° relative to an emission direction of the fluid from the emission nozzle 51. This allows the straightening plate 52 to dam the fluid emitted from the emission nozzle 51 and having passed over the support surface 13 and to direct the fluid further downstream over the support surface 13 while keeping momentum of the flow of the fluid.

The control unit 60 controls the servomotors 22, 43 of the press shaft 20 and the chip discharge mechanism 40 and further controls a fluid emission timing of the fluid emission unit 50. Specifically, the control unit 60 controls the servomotor 22 of the press shaft 20 so that the upper die M1 is lifted up and down at a predetermined timing and by a predetermined distance. Based on information from a force detection unit 70 that detects a pressing force of the lower die support 30, which is generated by the servomotor 43 of the chip discharge mechanism 40, against the support surface 13, the control unit 60 controls the servomotor 43 so that the pressing force is equal to or larger than a predetermined threshold. The force detection unit 70 is configured to detect the pressing force by detecting an electric current supplied to the servomotor 43 and thus does not require any special sensor.

Further, the control unit 60 activates the fluid emission units 50 to emit the fluid from the emission nozzles 51 at a timing when the chip discharge mechanism 40 moves the lower die support 30 away from the support surface 13.

Figure 11:
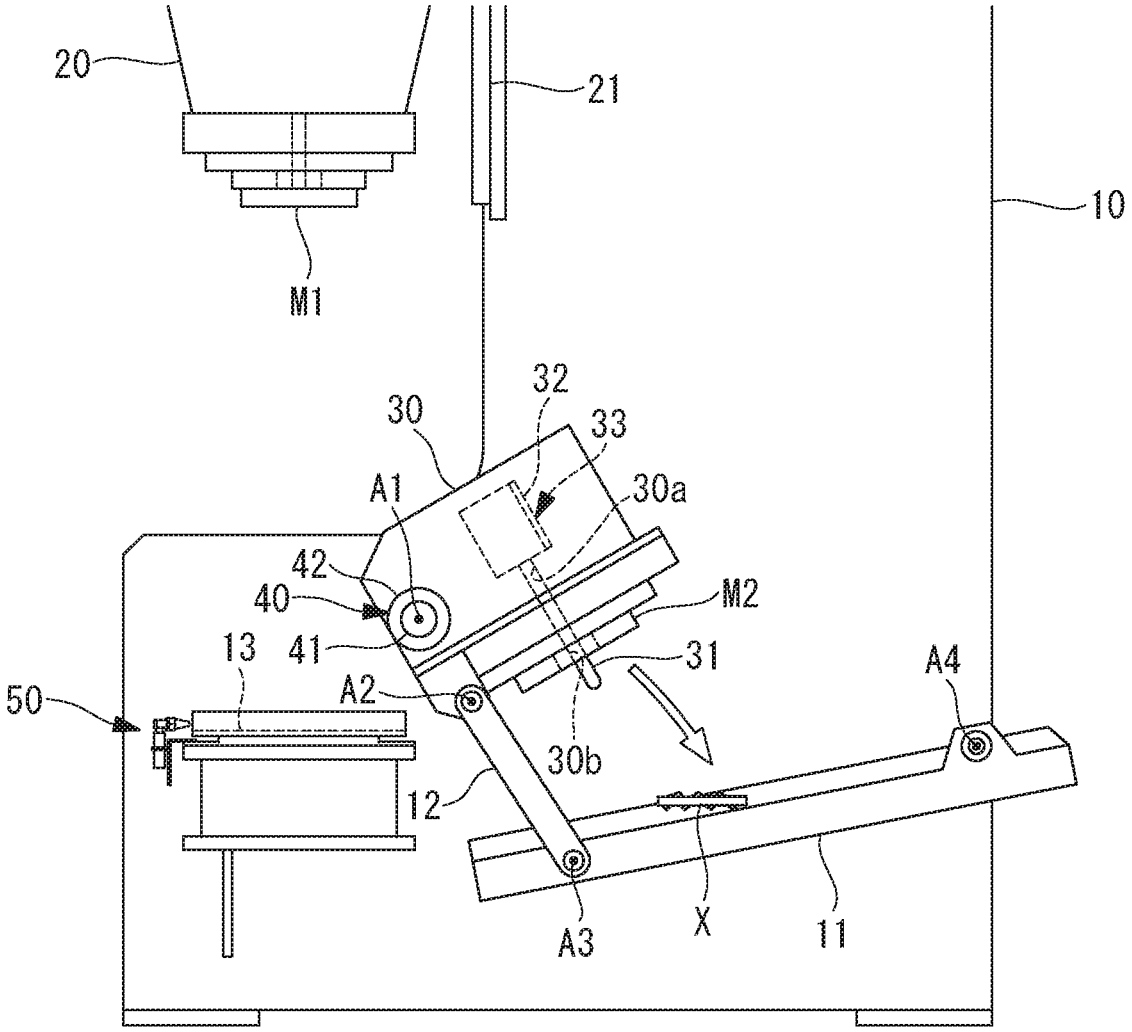
FIG. 11 is a diagram explaining the operation of the press apparatus of FIG. 1.

In a state where the lower die support 30 is supported by the support surface 13, a top face of the lower die support 30 is mounted with a lower die M2 for press work. Also, an ejector pin 31 and an air cylinder 32 for vertically moving the ejector pin 31 are provided inside the lower die support 30, as shown in FIG. 11. The ejector pin 31 and the air cylinder 32 constitute an ejector 33.

Figure 6:
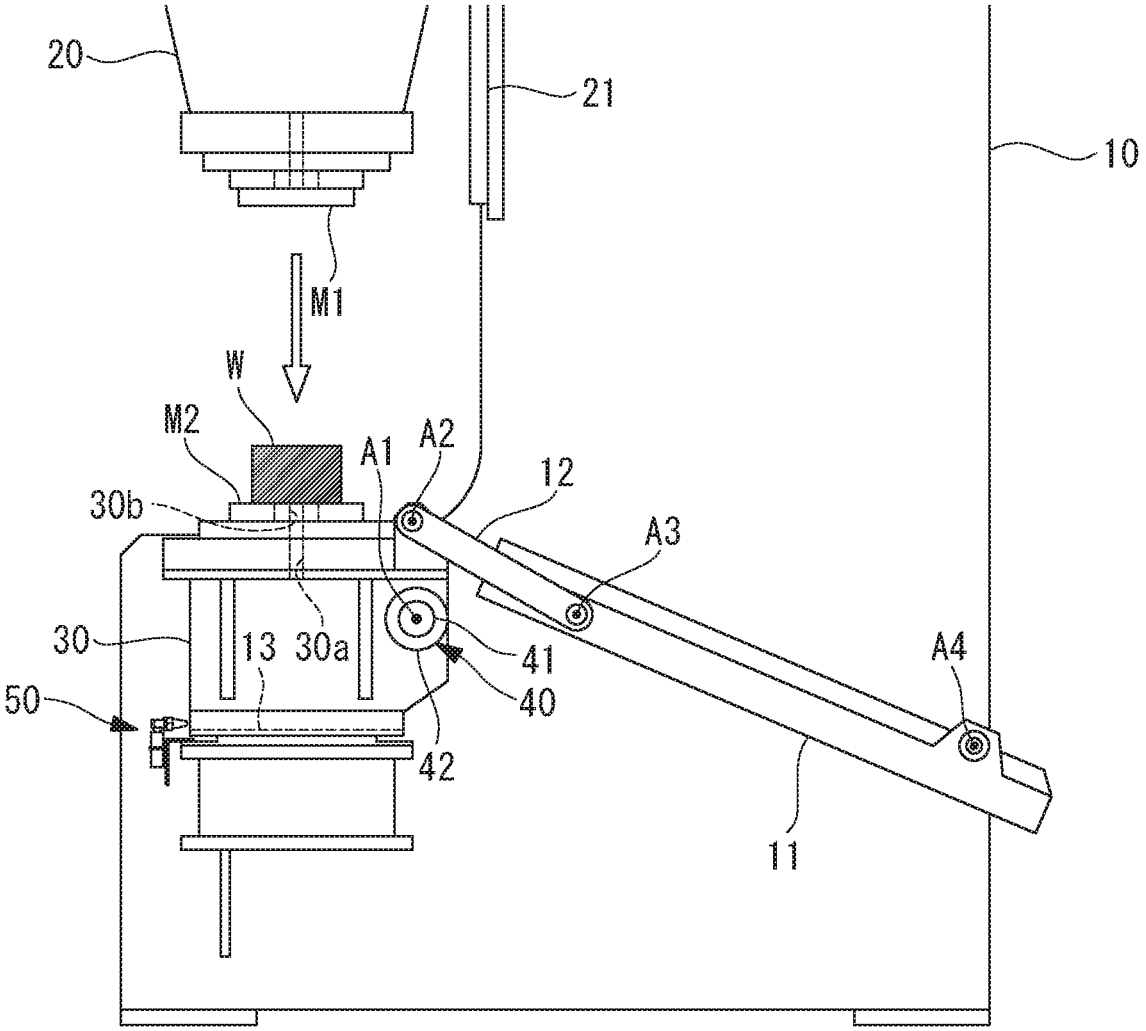
FIG. 6 is a diagram explaining an operation of the press apparatus of FIG. 1.

As shown in FIG. 6, an ejector pin hole 30*a* vertically runs inside the lower die support 30, and a hole 30*b* vertically runs inside the lower die M2 at a position corresponding to the ejector pin hole 30*a*. The ejector pin 31 is disposed within the ejector pin hole 30*a*. The air cylinder 32 moves the ejector pin 31 between a position where a distal end of the ejector pin 31 protrudes from the hole 30*b* of the lower die M2 and a position where the distal end does not protrude from the hole 30*b* of the lower die M2.

As shown in FIG. 2, one end of each link member 12 is connected to the lower die support 30 so as to be rotatable around a horizontal shaft A2. The other end of each link member 12 is connected to one end of the chip shooter 11 so as to be rotatable around a horizontal shaft A3.

Also, the other end of the chip shooter 11 is connected to the frame 10 so as to be rotatable around a horizontal shaft A4.

Activating the servomotor 43 of the chip discharge mechanism 40 causes the lower die support 30 to rotate away from the support surface 13 toward the chip shooter 11 or rotate toward the support surface 13. In response to rotation of the lower die support 30, a position of the shaft A2 moves toward the chip shooter 11 or toward the support surface 13 in the horizontal direction.

Figure 9:
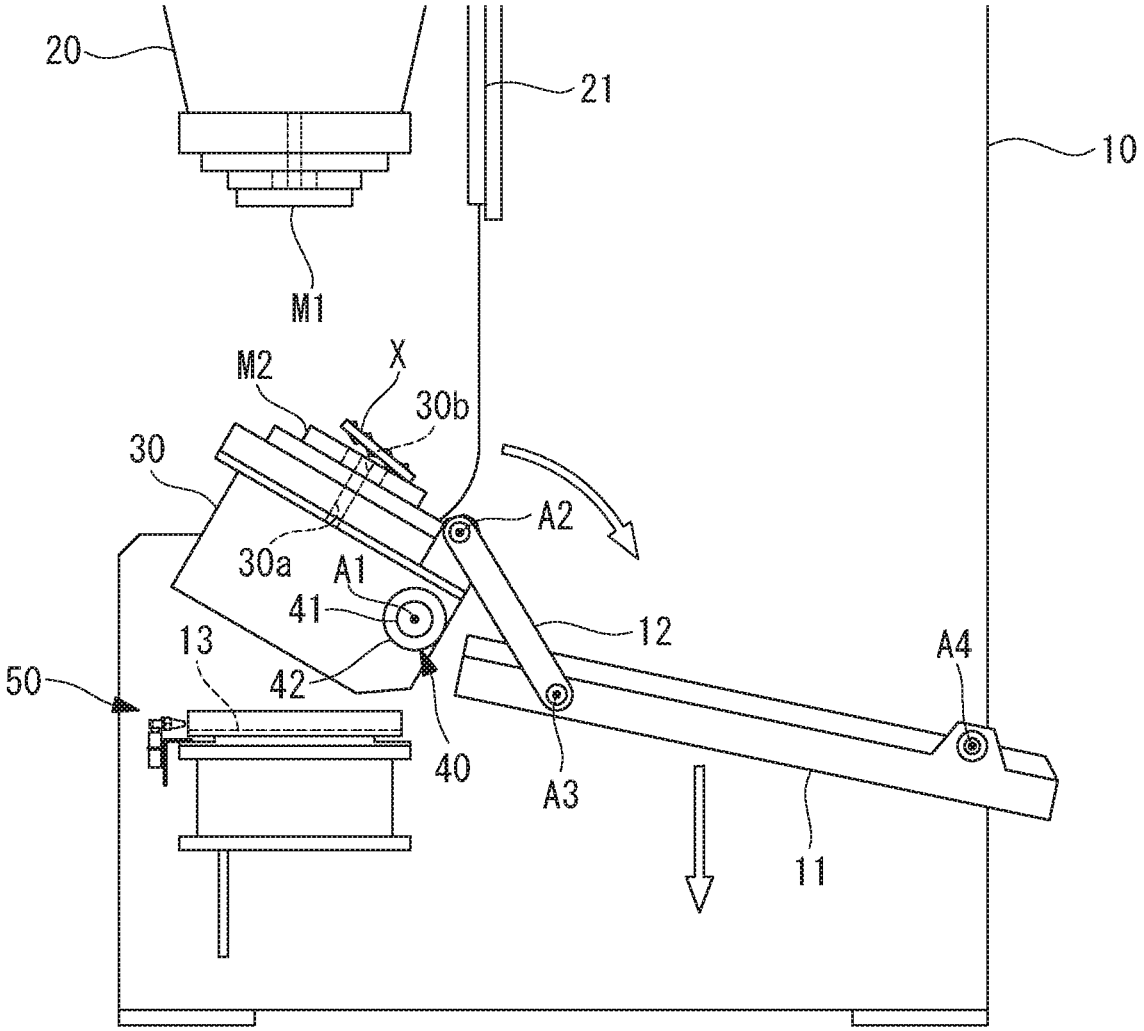
FIG. 9 is a diagram explaining the operation of the press apparatus of FIG. 1.
Figure 10:
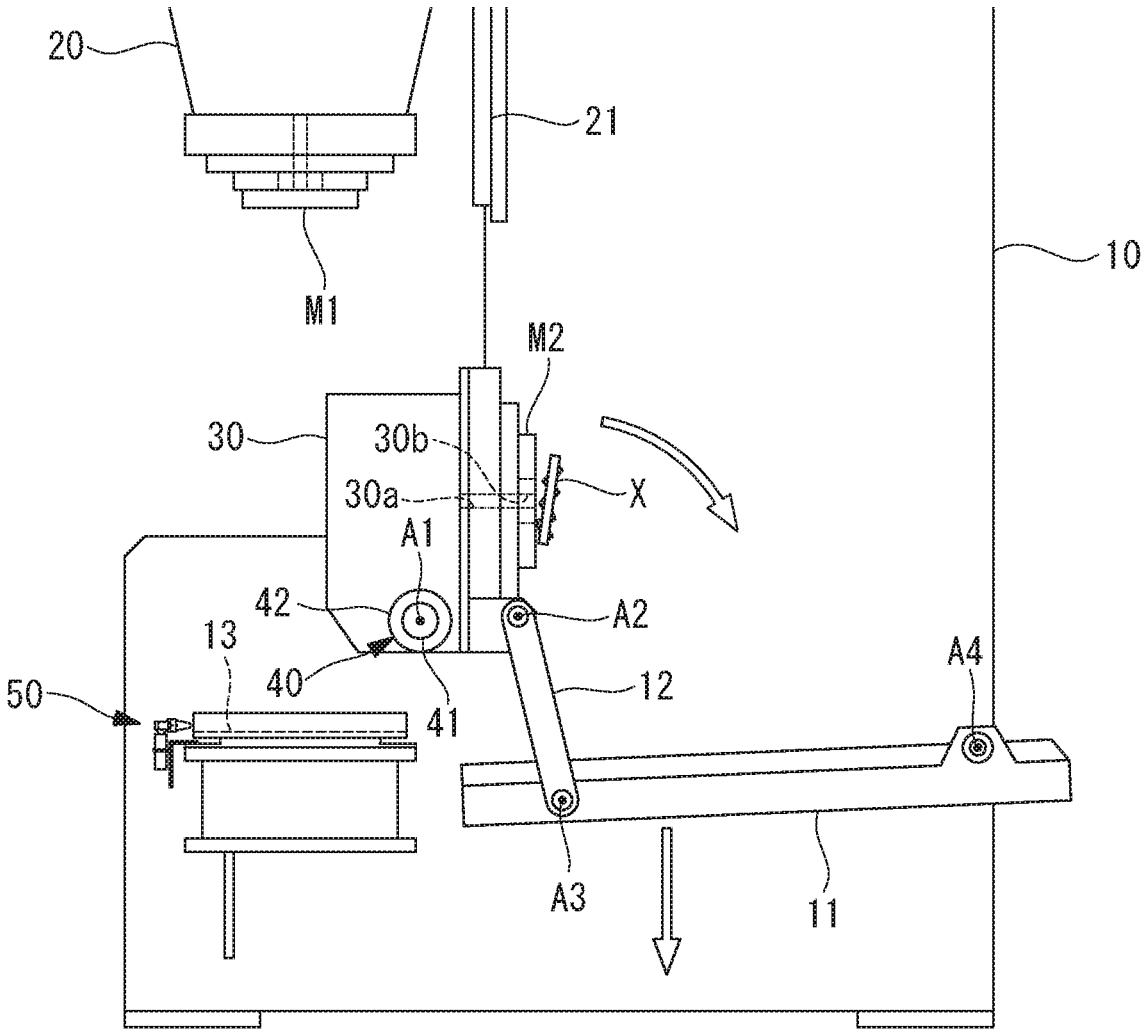
FIG. 10 is a diagram explaining the operation of the press apparatus of FIG. 1.

The shaft A3 is disposed between the shaft A2 and the shaft A4 in the horizontal direction, and the support shaft 41 and the shaft A4 are fixed to the frame 10. As a result, when the lower die support 30 with its bottom face supported by the support surface 13 rotates toward the chip shooter 11 as shown in FIGS. 9 to 11, a distance between the shaft A2 and the shaft A4 becomes shorter, which in turn results in the shaft A3 moving downward. That is, the one end of the chip shooter 11 moves downward.

Figure 12:
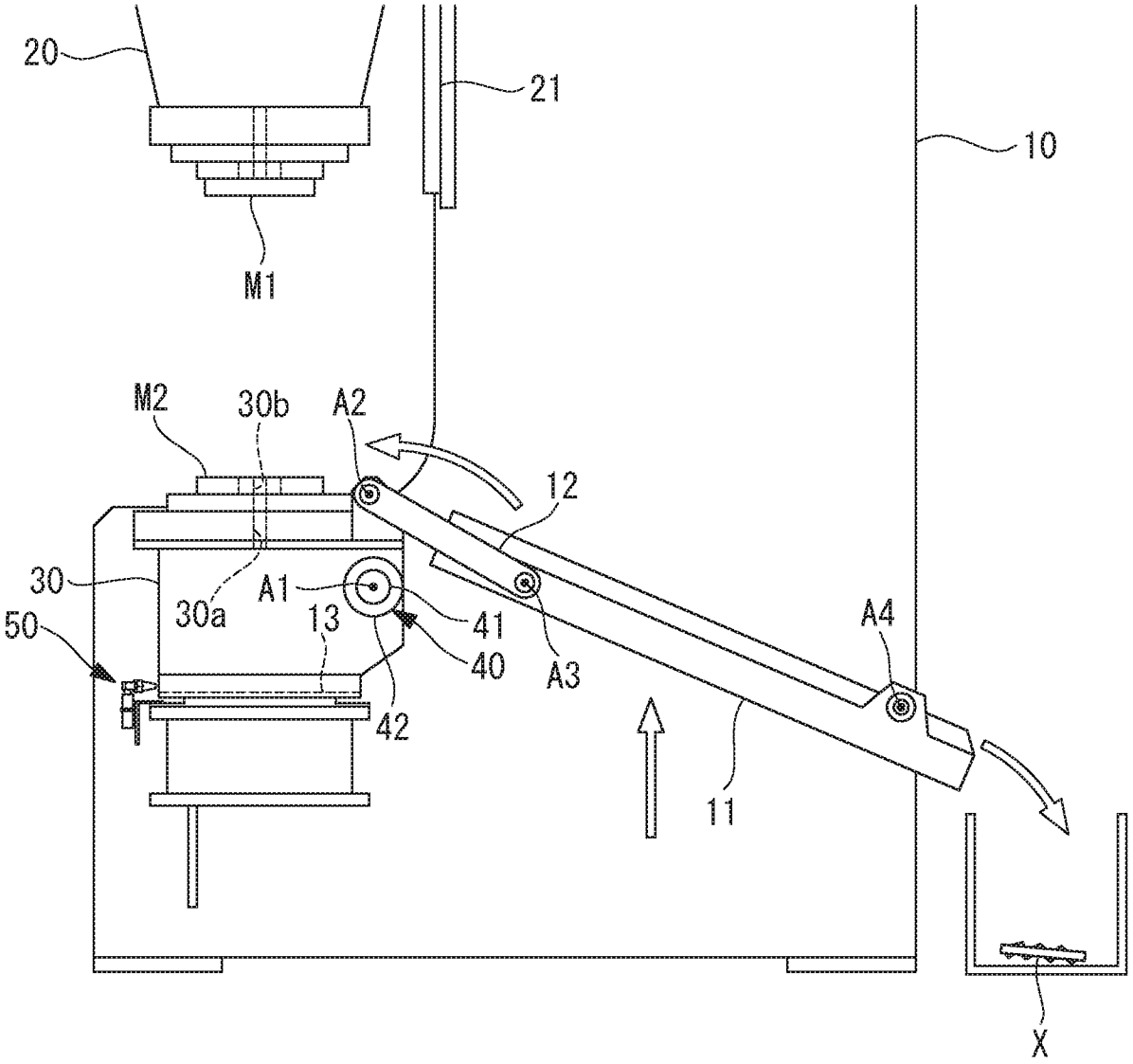
FIG. 12 is a diagram explaining the operation of the press apparatus of FIG. 1.

On the other hand, when the lower die support 30 rotates such that its bottom face contacts the support surface 13 as shown in FIG. 12, the distance between the shaft A2 and the shaft A4 becomes longer, which in turn results in the shaft A3 moving upward. That is, the one end of the chip shooter 11 moves upward.

Figure 13:
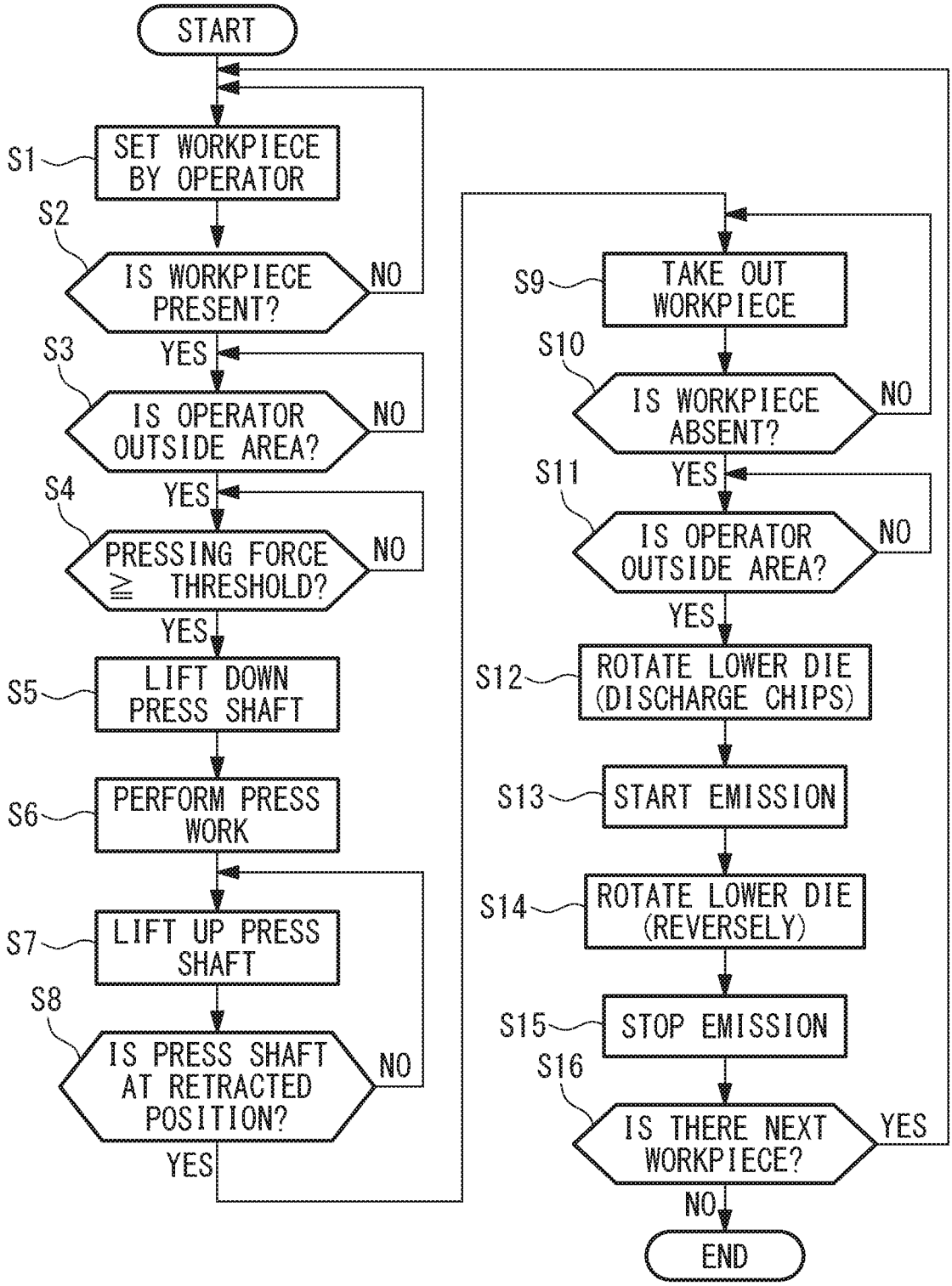
FIG. 13 is a flowchart explaining the operation of the press apparatus of FIG. 1.

An operation of the press apparatus 1 of the present embodiment configured as above will be explained below with reference to the flowchart of FIG. 13.

In performing press work using the press apparatus 1 of the present embodiment, a workpiece W is first placed on the lower die M2 by a workpiece transfer apparatus such as a robot or by an operator in a state where the press shaft 20 is located at an upper position and the lower die support 30 rests on the support surface 13 (step S1), as shown in FIG. 6.

Then, a sensor (not shown in the figure) detects presence or absence of the workpiece W on the lower die M2 (step S2), and when the workpiece W is present, a sensor (not shown in the figure) detects presence or absence of an operator within a predetermined area around the press apparatus 1 (step S3). When no operator is present within the predetermined area, the servomotor 43 is activated such that the lower die support 30 is pressed against the support surface 13 with a pressing force equal to or larger than a predetermined threshold (step S4).

Figure 7:
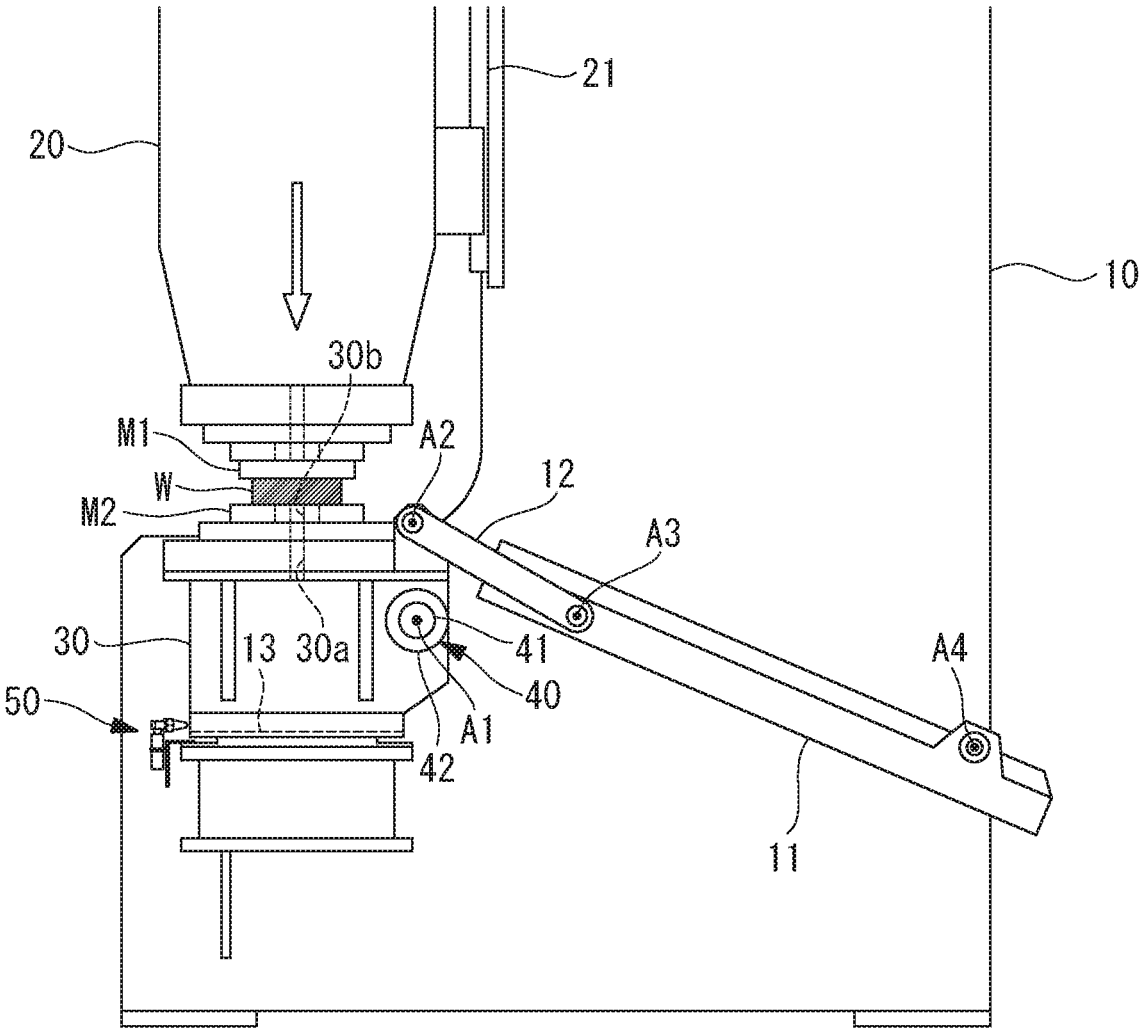
FIG. 7 is a diagram explaining the operation of the press apparatus of FIG. 1.
Figure 8:
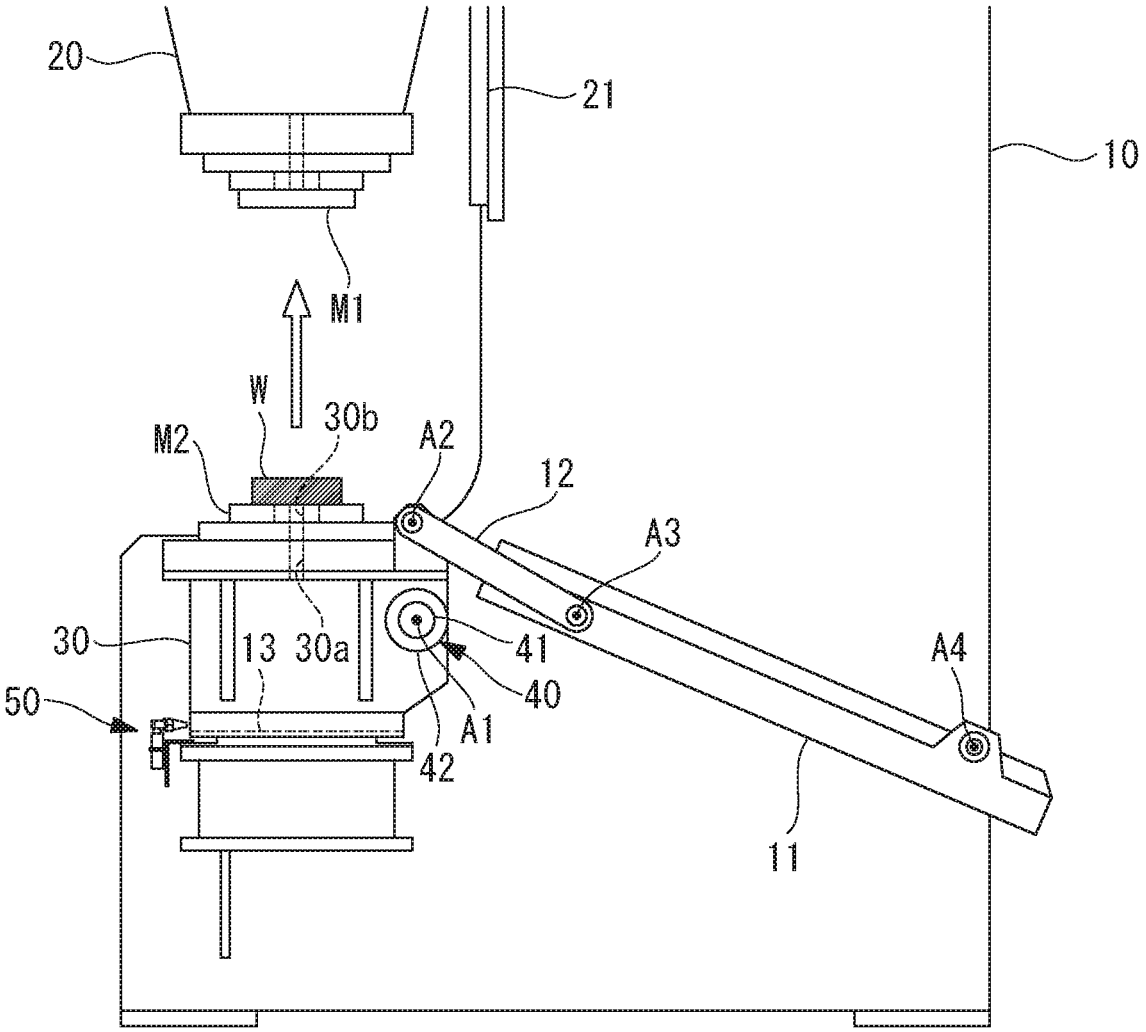
FIG. 8 is a diagram explaining the operation of the press apparatus of FIG. 1.

When the lower die support 30 is pressed against the support surface 13 with a pressing force equal to or larger than the predetermined threshold, a press work operation is initiated. The press shaft 20 moves downward as shown in FIG. 7 (step S5), and press work including cutting, drilling and elastic deformation of the workpiece W is performed between the upper die M1 and the lower die M2 (step S6). Thereafter, the press shaft 20 is lifted up to a retracted position located above (steps S7 and S8).

In this state, the workpiece W having undergone the press work is taken out of the lower die M2 by the workpiece transfer apparatus or by the operator and moved to another place (step S9). Then, the sensor (not shown in the figure) detects presence or absence of the workpiece W on the lower die M2 (step S10). When the absence of the workpiece W is confirmed, the sensor then confirms that the operator or the workpiece transfer apparatus is not present within the predetermined area around the press apparatus 1 (step S11). After confirmation of the absence, a chip discharge operation is performed.

To perform the chip discharge operation, the control unit activates the servomotor 43, which constitutes the chip discharge mechanism 40, to rotate the lower die support 30 around the support shaft 41 (step S12). This causes the lower die support 30 to rotate toward the chip shooter 11 and causes the lower die M2 on the lower die support 30 to be tilted toward the chip shooter 11 too, as shown in FIGS. 9 and 10. An angle of rotation of the lower die support 30 from the position where the lower die support 30 rests on the support surface 13 is not limited to a particular angle. However, the angle of rotation is preferably 90° or more because such angle of rotation allows for easily dropping chips X from the lower die M2.

As shown in FIG. 11, in a state where the lower die M2 is sufficiently tilted, the air cylinder 32 causes the ejector pin 31 to protrude from the lower die M2. This causes the chips X remaining on the lower die M2 to drop onto the chip shooter 11.

Further, in the press apparatus 1 of the present embodiment, when the lower die support 30 starts to rotate away from the support surface 13 as shown in FIG. 9, the control unit 60 activates the fluid emission unit 50 to emit air toward the support surface 13 (step S13).

The air emitted from the emission nozzles 51 of the fluid emission unit 50 is blown onto the support surface 13, sweeping away the chips X remaining on the support surface 13. Further, the air passing over the support surface 13 is dammed by the straightening plates 52 on the respective sides of the support surface 13 and directed to flow further downstream over the support surface 13 while keeping its momentum. This allows to remove dust including the remaining chips X from the almost entire area of the support surface 13.

In the present embodiment, as shown in FIG. 12, the control unit 60 activates the servomotor 43 of the chip discharge mechanism 40 to rotate the lower die support 30 back toward the support surface 13 while the fluid emission unit 50 is emitting the air (step S14). As a result, the air emitted from the emission nozzles 51 is made to flow through a narrow gap between the support surface 13 and the lower die support 30 immediately before the lower die support 30 contacts the support surface 13. This rapid air stream even removes fine dust attached to the support surface 13 and the bottom face of the lower die support 30.

Then, when the lower die support 30 is placed back onto the support surface 13, emission of the air from the emission nozzles 51 is stopped (step S15), and it is determined whether all workpieces W have undergone the press work (step S16). When not all workpieces W have undergone the press work, steps from step S1 are repeated.

When the lower die support 30 is placed back onto the support surface 13, the air cylinder 32 causes the ejector pin 31 not to protrude from the lower die M2. This allows the lower die M2 to receive a next workpiece W.

As described above, according to the present embodiment, in the press apparatus 1 including the chip discharge mechanism 40 that discharges the chips X by rotating the lower die support 30, the servomotor 43 is controlled so that the lower die support 30 is pressed against the support surface 13 with a pressing force equal to or lager than a predetermined threshold. This allows the support surface 13 to receive a large pressing force applied from the press shaft 20 to the workpiece W during the press work, and this in turn allows to more reliably prevent an excessive force from acting on the support shaft 41. This is advantageous in that the support shaft 41 and the servomotor 43 may be maintained in good condition.

Also, the fluid emission unit 50 sweeps away dust including the chips attached to the support surface 13. This allows to more reliably avoid a situation where the press work is performed with the chips X being left between the lower die support 30 and the support surface 13. This is advantageous in that tilting of the lower die support 30 and the lower die M2 due to presence of the chips X between the lower die support 30 and the support surface 13 may be more reliably prevented and thus the press work may be precisely performed.

In the present embodiment, the press shaft 20 is driven by the servomotor 22, the ball screw 23 and the like. However, instead of these components, any known mechanism for vertically moving the press shaft 20 may be used, such as one using a hydraulic cylinder, one using the servomotor 22, a screw and a link, and one using a motor and a crank or a cam.

The pressing force with which the lower die support 30 is pressed against the support surface 13 is detected from an electric current supplied to the servomotor 43. However, instead of this, a force sensor may be disposed between the support surface 13 and the frame 10 to detect the pressing force.

The fluid emission unit 50 may emit, instead of air, any other gas or liquid from the emission nozzles 51.

From the above-described embodiment, the following invention is derived.

According to an aspect of the present invention, a press apparatus is provided that includes: a frame including a support surface, the support surface allowing a lower die support for supporting a lower die to rest on the support surface in close contact therewith; a press shaft configured to support an upper die facing the lower die from vertically above the lower die and to vertically move the upper die relative to the frame in a state where the lower die support rests on the support surface; a chip discharge mechanism configured to rotate the lower die support around a horizontal axis; a force detection unit configured to detect a pressing force of the lower die support against the support surface; and a control unit configured to control the chip discharge mechanism so that the pressing force detected by the force detection unit is equal to or larger than a predetermined threshold.

According the above aspect, in a state where the press shaft supporting the upper die is at a vertically upper position and the lower die support supporting the lower die rests on the support surface of the frame in close contact with the support surface, a workpiece is placed on the lower die. Then the press shaft is lifted down to perform the press work on the workpiece between the lower die and the upper die, as a result of which chips remain on the lower die. After the workpiece is taken out by a robot or the like, the chip discharge mechanism is activated to rotate the lower die support around the horizontal axis and to thereby tilt the lower die, by which the chips remaining on the lower die are discharged.

After that, the chip discharge mechanism reversely rotates the lower die support to rest it on the support surface of the frame. This allows to proceed with the press work on a next workpiece. In this case, the pressing force of the lower die support against the support surface is detected by the force detection unit, and the chip discharge mechanism is controlled by the control unit so that the detected pressing force is equal to or larger than a predetermined threshold.

This allows the chip discharge mechanism to rotate the lower die support until the lower die support is pressed against the support surface with a pressing force equal to or larger than the predetermined threshold, even when the chips or the like are present between the lower die support and the support surface or when the lower die support is displaced by an external force acting on the lower die support. As a result, when the press work on the next workpiece takes place, a large force applied by the press shaft is received by the support surface. This prevents an excessive force from acting on the actuator or the horizontal shaft of the chip discharge mechanism, enabling to maintain the actuator or the horizontal shaft in good condition.

In the above aspect, the press apparatus may include a fluid emission unit configured to emit a fluid toward the support surface in a state where the lower die support is rotated to tilt the lower die.

Even when chips attach to the support surface in a state where the lower die support is rotated away from the support surface for discharge of chips, the attached chips are removed by a fluid emitted toward the support surface by this fluid emission unit. This allows to reduce a possibility of chips being present between the support surface and the lower die support, which in turn allows to precisely position the lower die and precisely perform the press work.

Further, in the above aspect, the press apparatus may include a straightening plate on a side of the support surface and standing perpendicularly to the support surface, and the fluid emission unit may emit the fluid from an opposite side of the support surface from the straightening plate and in an inclined direction relative to the straightening plate.

The fluid emitted toward the support surface by the fluid emission unit removes chips on the support surface, and the fluid having passed over the support surface is dammed by this straightening plate and directed to flow over the support surface. This allows to fully utilize the emitted fluid to efficiently remove the chips on the support surface.

Further, in the above aspect, the chip discharge mechanism may include a servomotor for rotating the lower die support, and the force detection unit may detect the pressing force on the basis of an electric current supplied to the servomotor.

Detecting an electric current supplied to the servomotor for rotating the lower die support allows to detect the pressing force between the lower die support and the support surface without requiring any special force sensor.

REFERENCE SIGNS LIST

1 Press apparatus
10 Frame
13 Support surface
20 Press shaft
30 Lower die support
40 Chip discharge mechanism
43 Servomotor
50 Fluid emission unit
52 Straightening plate
60 Control unit
A1 Horizontal axis
M1 Upper die
M2 Lower die

The invention claimed is:

1. A press apparatus comprising:

a frame including a support surface, the support surface allowing a lower die support for supporting a lower die to rest on the support surface in close contact therewith;

a press shaft configured to support an upper die facing the lower die from vertically above the lower die and to vertically move the upper die relative to the frame in a state where the lower die support rests on the support surface;

a chip discharge mechanism configured to rotate the lower die support around a horizontal axis;

a force detection unit configured to detect a pressing force of the lower die support against the support surface; and a control unit configured to control the chip discharge mechanism so that the pressing force detected by the force detection unit is equal to or larger than a predetermined threshold.

2. The press apparatus according to claim 1, further comprising a fluid emission unit configured to emit a fluid toward the support surface in a state where the lower die support is rotated to tilt the lower die.

3. The press apparatus according to claim 2, further comprising a straightening plate on a side of the support surface, the straightening plate standing perpendicularly to the support surface, wherein the fluid emission unit is configured to emit the fluid from an opposite side of the support surface from the straightening plate and in an inclined direction relative to the straightening plate.

4. The press apparatus according to claim 1, wherein the chip discharge mechanism includes a servomotor for rotating the lower die support, and the force detection unit detects the pressing force on a basis of an electric current supplied to the servomotor.

* * * * *